US006276270B1

(12) United States Patent
Leanna

(10) Patent No.: US 6,276,270 B1
(45) Date of Patent: Aug. 21, 2001

(54) INK DISTRIBUTTON APPARATUS AND METHOD FOR ANILOX ROLL

(75) Inventor: Dale D. Leanna, Townsend, WI (US)

(73) Assignee: Interflex, L.L.C., Green Bay, WI (US)

( * ) Notice: Subject to any disclaimer, the term of this patent is extended or adjusted under 35 U.S.C. 154(b) by 0 days.

(21) Appl. No.: 09/378,328

(22) Filed: Aug. 20, 1999

(51) Int. Cl.[7] ..... B41F 31/05
(52) U.S. Cl. ..... 101/350.6; 101/366; 118/413
(58) Field of Search ..... 101/349.1, 350.1, 101/350.6, 352.09, 365, 366, 154, 155, 157; 118/413

(56) References Cited

U.S. PATENT DOCUMENTS

| | | | | |
|---|---|---|---|---|
| Re. 35,471 | | 3/1997 | Weishew | 101/208 |
| 2,514,556 | | 7/1950 | Peyrebrune et al. | 101/364 |
| 2,655,102 | | 10/1953 | Ross | 101/157 |
| 3,120,802 | | 2/1964 | Smejda | 101/157 |
| 3,273,535 | | 9/1966 | Krikorian | 101/364 |
| 3,659,553 | * | 5/1972 | Tobias | 118/261 |
| 3,783,781 | * | 1/1974 | Grommek | 101/169 |
| 3,981,238 | | 9/1976 | Dini | 101/154 |
| 4,408,528 | | 10/1983 | Johne et al. | 101/364 |
| 4,479,434 | * | 10/1984 | Armelin | 101/365 |
| 4,669,382 | | 6/1987 | Jentzsch et al. | 101/365 |
| 4,735,144 | * | 4/1988 | Jenkins | 101/425 |
| 4,991,504 | | 2/1991 | Fina | 101/208 |
| 5,239,925 | * | 8/1993 | Bobo | 101/366 |
| 5,267,793 | | 12/1993 | Hawitt | 101/364 |
| 5,345,867 | * | 9/1994 | Schneider et al. | 101/363 |
| 5,642,664 | | 7/1997 | Schneider | 101/123 |
| 5,656,083 | * | 8/1997 | Schonberger | 101/363 |
| 6,029,573 | * | 2/2000 | Capadeboscq | 101/350.6 |

* cited by examiner

*Primary Examiner*—Daniel J. Colilla
(74) *Attorney, Agent, or Firm*—Boyle Fredrickson Newholm Stein & Gratz S.C.

(57) ABSTRACT

This invention is an improved apparatus and method for distributing ink in a printing press. In preferred embodiments, ink on an anilox roll is uniformly distributed on the roll by the scraping action of doctor blades against the roll surface. The blades are held in continuous engagement against the anilox roll by an adjustment mechanism which exerts a constant force against the doctor blades. The preferred adjustment mechanism is a cam or cams under the control of an actuator. The actuator causes each cam to rotate against a moveable support on which the doctor blades are mounted urging the doctor blades against the anilox roll. The actuator provides a constant force to each cam thereby causing the blades to be constantly urged against the anilox roll surface even as the blades are worn away by operation of the printing press. By keeping the doctor blades in constant contact with the anilox roll surface, the invention ensures even ink distribution over the anilox roll and, ultimately over the surface to be printed, avoids ink leakage and avoids the need to manually readjust the position of the doctor blades relative to the anilox roll surface.

18 Claims, 4 Drawing Sheets

INK DISTRIBUTTON APPARATUS AND METHOD FOR ANILOX ROLL

FIELD OF THE INVENTION

The present invention relates generally to printing press technology, and, more particularly, to improved apparatus and method for distribution of ink used in printing presses.

BACKGROUND OF THE INVENTION

Printing presses are well-known devices for mass production of printed media. In certain types of printing presses, such as flexographic printing presses, a web of paper or other material is imprinted by passing the web through the press and between a rotating impression cylinder and a rotating plate cylinder. Ink is transferred from the plate cylinder onto the web in a predetermined manner corresponding to the type or other indicia on the printing plate affixed to the plate cylinder. The printed web is then processed further, such as through additional imprinting or appropriate collating, folding, cutting or other desired process, to result in the final product.

A significant problem facing manufacturers and operators of flexographic and other types of printing presses involves proper application of ink to the web. In flexographic printing, for example, the ink is applied to the plate cylinder in a precise manner by a rotating anilox metering roll. The anilox roll is positioned to abut the plate cylinder so that an edge surface of the anilox roll is in contact with an edge surface of the plate cylinder. The circumferential surface of the anilox roll typically is engraved to include a large number of recesses for holding ink in a precise volumetric manner. Ink is transferred from the anilox roll to the printing plate mounted on the plate cylinder as the anilox roll edge surface rotates against the edge surface of the printing plate.

Ink is applied to the surface of the anilox roll by an ink applicator head. The applicator head may include doctor blades which contact the anilox roll above and below the head. The applicator head, doctor blades and anilox roll surface form a closed chamber. One or more ink jets within the applicator head chamber direct a stream of ink onto the anilox roll surface as the anilox roll is rotated about the applicator head. The doctor blades serve the important purpose of removing excess ink from the surface of the anilox roll as the roll is rotated. Excess ink removed from the surface of the anilox roll by the doctor blades is collected in a reservoir provided in the applicator head chamber.

This arrangement permits ink to be precisely metered onto the plate cylinder because only the volumetric amount of ink held in the recesses on the anilox roll surface is applied to the plate cylinder with any excess ink being removed by the scraping action of the doctor blades as the anilox roll is rotated. It is essential to maintain continuous contact between the doctor blades and the surface of the anilox roll to ensure that only the desired amount of ink is metered onto the plate cylinder. Continuous contact between the doctor blades and the anilox roll surface is also Ad important to maintain a sealing relationship between the applicator head and the anilox roll surface so as to prevent leakage of ink from the printing press.

A significant problem occurs when continuous contact between the doctor blades and the anilox roll surface is broken. Contact can be broken when the doctor blades becomes worn—a common occurrence during operation of the printing press. The doctor blades can become worn for a number of reasons including, for example, from abrasion by abrasive constituents present in waterborne inks. This concern is expected to grow as the ratio of abrasive constituents in the ink increases due to removal of volatile organic compounds from the inks in order to address environmental concerns. Other factors contributing to doctor blade wear include: the degree to which the anilox roll is engraved and polished, line speed, blade pressure, blade angle, the type of material used to form the blade and whether the blade includes a beveled surface.

The continuous contact between the doctor blades and the anilox roll surface may be broken by doctor blade wear because the applicator head holding the doctor blades is typically held in a single position directly against the anilox roll at the start of the printing process. As the doctor blade surfaces become worn, a gap is formed between the doctor blades and the anilox roll surface. The position of the applicator head must be constantly monitored and adjusted to continuously reposition the doctor blades against the anilox roll surface. Failure to constantly monitor and adjust the position of the doctor blades relative to the anilox roll will result in inadequate removal of excess ink from the anilox roll and ink leakage.

An improved printing press system which would automatically and constantly adjust the position of doctor blades relative to an anilox roll to ensure proper ink distribution to a web and which would avoid ink leakage from the press would represent an important advance in the art.

OBJECTS OF THE INVENTION

It is an object of this invention to provide an improved printing press ink distribution apparatus and method overcoming some of the problems and shortcomings of devices and methods of the prior art.

Another object of this invention is to provide an improved apparatus and method for distributing ink to a web in a precise, controlled manner.

Yet another object of this invention is to provide an improved apparatus and method for maintaining continuous contact between a doctor blade and an anilox roll surface.

A further object of this invention is to provide an improved apparatus and method for automatically and continuously adjusting the position of a doctor blade relative to an anilox roll surface.

It is also an object of this invention to provide an improved printing press apparatus and method which overcomes the effect of doctor blade wear.

Another object of this invention is to provide an improved apparatus and method for positioning a doctor blade against an anilox roll surface prior to beginning the printing process.

These and other objects will be apparent from the following descriptions and from the drawings.

SUMMARY OF THE INVENTION

The present invention may be summarized as an improved applicator system for distributing ink applied to an anilox roll. The apparatus includes a blade for distributing ink applied to an anilox roll and an adjustment mechanism for supporting the blade against the anilox roll. The adjustment mechanism automatically and continuously biases the blade against the anilox roll with a constant force. "Constant force" as used in this application means that the force urging the blade against the anilox roll is maintained even as the blade or blades are worn through use of the printing press.

This arrangement is advantageous because it maintains continuous contact between each blade and the anilox roll surface ensuring appropriate distribution of ink from, for example, an anilox roll to a plate cylinder and ultimately onto the web to be printed. The apparatus also prevents leakage of ink from the interface between the blades and the anilox roll.

In preferred embodiments, the apparatus includes an applicator head with a pair of doctor blades attached at the top and bottom ends of the head. The applicator head may be mounted on a moveable support for moving the head toward the anilox roll. Preferably, an actuator moves a biasing device which engages the support and moves the support and doctor blades toward the anilox roll such that the blades engage the anilox roll under a constant force.

It is most highly preferred that the head and doctor blades are urged against the anilox roll surface by a camming system. The camming system preferably comprises an actuator for maintaining a constant force on a shaft, a shaft rotated by the actuator and a cam mounted on, and rotated by the shaft. The cam of this embodiment has an eccentric camming surface for engaging the moveable support and for urging the support (and applicator head and doctor blades) toward the anilox roll.

Another important feature of preferred embodiments of the invention is that the applicator head and doctor blades may be automatically positioned against the anilox roll in an indexed, predetermined manner. Indexing of the movement of the doctor blades is advantageous because it allows the blades to be brought into engagement with the anilox roll in a gradual, controlled manner thus ensuring a proper fit between the blades and the anilox roll and minimizing potential damage to either the blades or the anilox roll as they are engaged. This preferred result is achieved by programming the actuator to rotate a shaft in a predetermined manner so that, through appropriate linkage, the rotational force of the actuator is translated to move the applicator head toward the anilox roll in a predetermined, controlled manner. It is most highly preferred that the actuator is programmed to urge the blades toward the anilox roll at first rate of movement followed by a decreased rate of movement as the blades engage the anilox roll.

The invention includes an improved method for distributing ink applied to an anilox roll surface comprising the steps of engaging the anilox roll surface with a blade, rotating the anilox roll, applying ink to the surface of the rotating anilox roll, distributing the ink on the rotating anilox roll surface with the blade and automatically applying a constant force biasing the blade against the anilox roll surface. Most highly preferred forms of the method use a camming action to urge the blade against the anilox roll.

It is also envisioned that certain preferred forms of the method may include automatic indexing of the blade against the anilox roll in a predetermined manner as described above. In preferred forms of this method, an actuator is programmed to position the applicator head and doctor blades, through appropriate linkage, against the anilox roll in a controlled manner.

DETAILED DESCRIPTION

Figure 1:
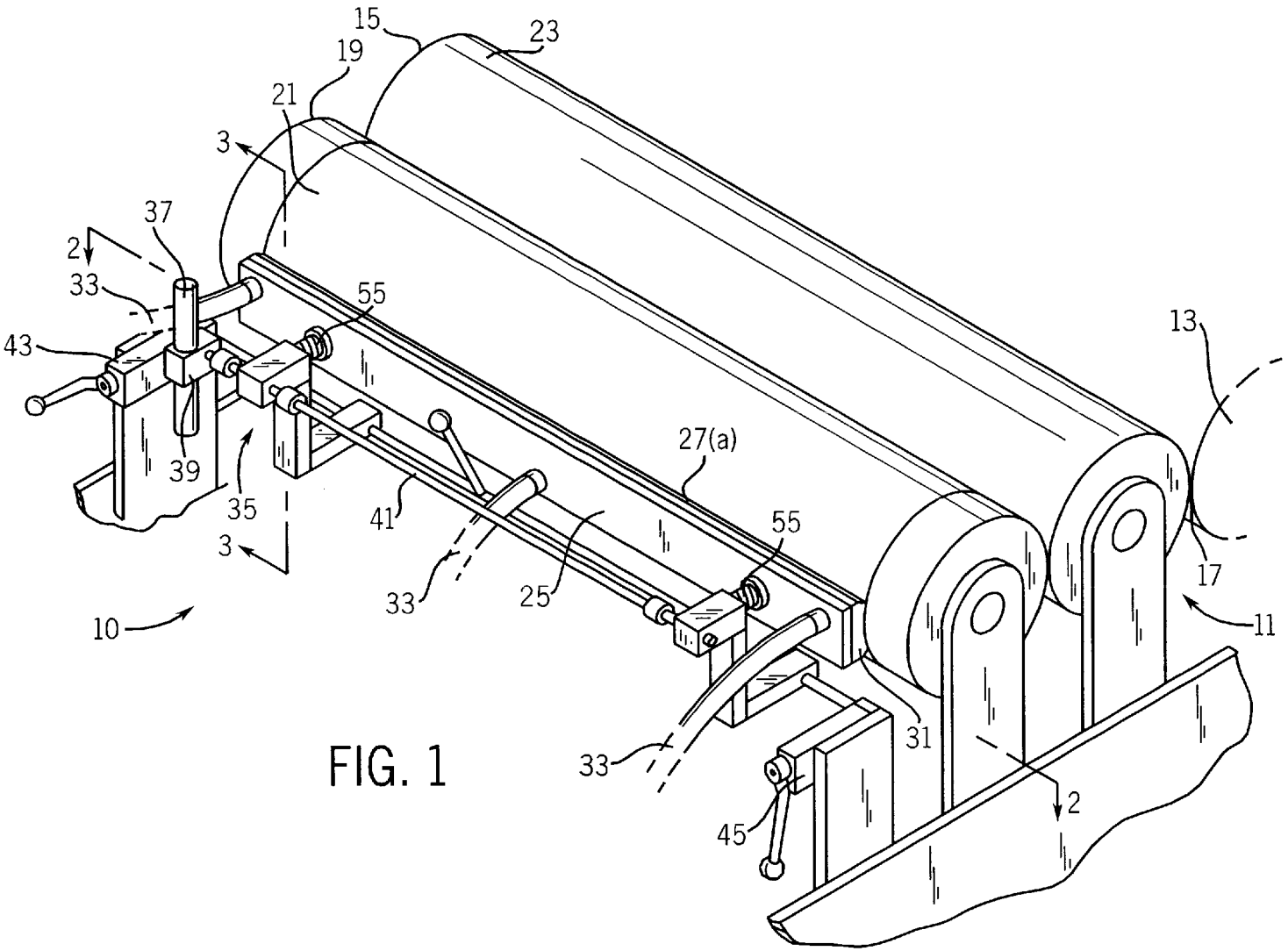
FIG. 1 is an isometric view of one embodiment of the improved ink distribution device including the applicator head, anilox roll and plate cylinder.

Following is a detailed description of one preferred embodiment of the invention as shown in FIGS. 1–4B. Referring first to FIG. 1, that drawing shows an exemplary apparatus 10 according to the invention together with a portion of a printing press 11. As shown in FIG. 1, impression cylinder 13 and plate cylinder 15 are positioned to abut each other and to rotate in opposite directions through operation of an appropriate mechanism (not shown). Web passageway 17 is formed between impression cylinder 13 and plate cylinder 15. A web (not shown) of paper or other material to be printed is fed through passageway 17. The type or other indicia to be printed on the web is affixed to plate cylinder 15, typically in the form of a rubber or other elastomeric printing plate (not shown). Ink is applied to plate cylinder 15 by abutting anilox roll 19. The web is printed with the type or other indicia as it passes between impression cylinder 13 and plate cylinder 15 and through passageway 17.

Referring further to FIG. 1, anilox roll 19 has an anilox roll surface 21 which is engraved with a plurality of ink receptacles (not shown) for holding ink and metering that ink onto plate cylinder 15. Anilox roll 19 is mounted to rotate in an opposite direction from plate cylinder 15 also through operation of an appropriate mechanism which is known to those of skill in the art and need not be illustrated. Anilox roll surface 21 abuts surface 23 of plate cylinder 15 to facilitate ink transfer from anilox roll 19 to plate cylinder 15 as anilox roll 19 and plate cylinder 15 rotate against the other.

Figure 3:
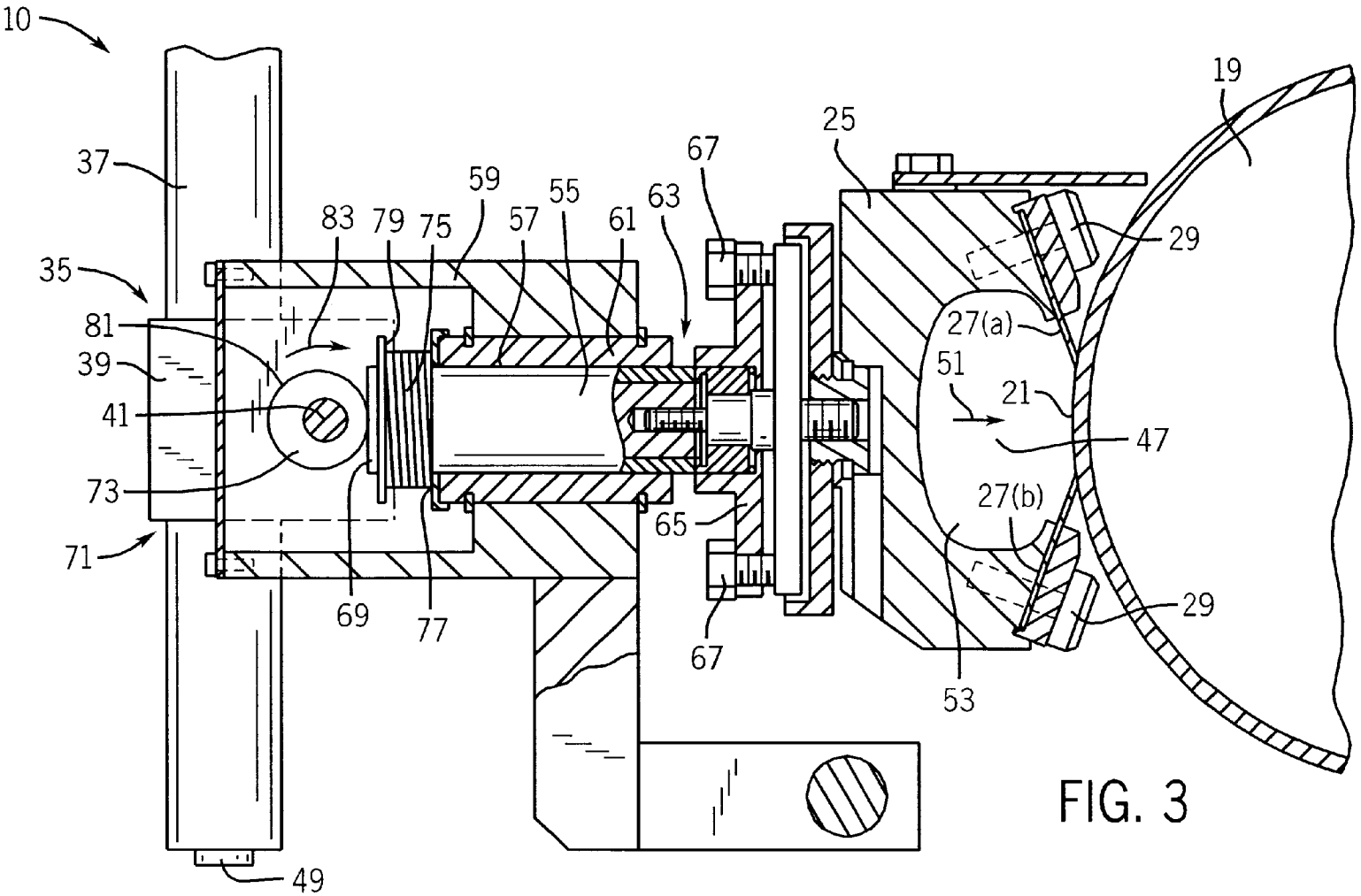
FIG. 3 is side sectional view, partially broken away, taken along section 3—3 of FIG. 1.
Figure 4A:
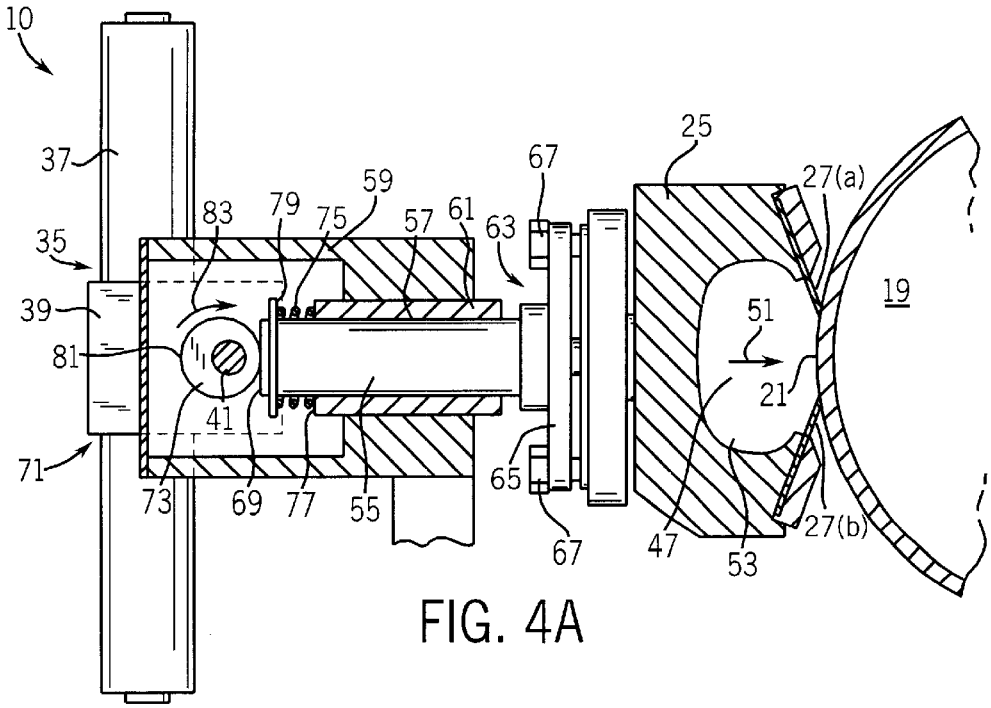
FIGS. 4A and 4B are side sectional views, partially broken away, showing the preferred camming action for urging the doctor blades against the anilox roll.
Figure 4B:
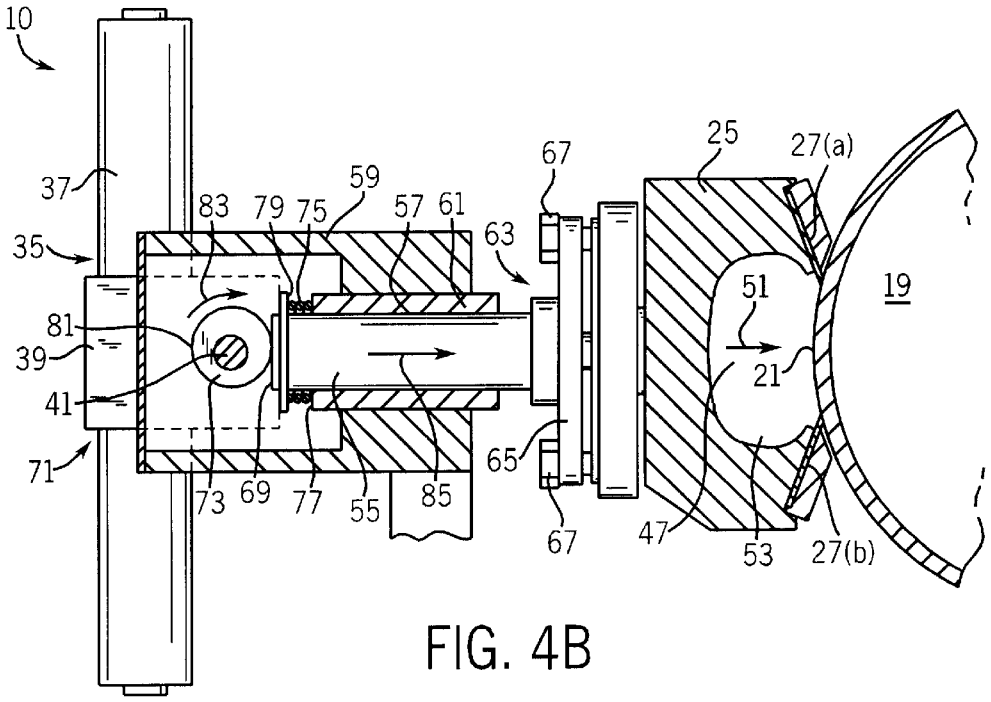

Ink is transferred to anilox roll 19 by applicator head 25, FIG. 3. In the preferred embodiment shown, applicator head 25 includes a doctor blade positioned above 27(*a*) and a doctor blade positioned below 27(*b*) applicator head 25 (hereinafter collectively referred to as "doctor blades 27"). Doctor blades 27 may be mounted on applicator head 25 through any suitable means, such as fastener 29. FIGS. 3, 4A and 4B show this arrangement of doctor blades 27 in greater detail. Applicator head 25 and doctor blades 27 each run along substantially the entire length of anilox roll 19. Other suitable arrangements of doctor blades 27 are intended to be within the scope of this invention. For example, one blade coupled with a seal could be used rather than upper and lower doctor blades. Doctor blades 27 may be made of any suitable material such as, for example, steel, plastic or composite materials. Applicator head 25 may include sidewalls 31.

A plurality of ink supply lines 33 for supplying ink to applicator head 25 are shown connected to applicator head 25. The supply lines 33 provide ink to ink jets (not shown) for supplying a stream of ink from applicator head 25 to anilox roll surface 21. Any suitable number of ink supply lines 33 or ink jets may be used.

FIG. 1 also shows components of adjustment mechanism 35 for supporting doctor blades 27 against anilox roll 19 and for automatically biasing doctor blades 27 against anilox roll 19 with a constant force. These components include actuator 37, linkage 39 and shaft 41. These components will be described in greater detail below. FIG. 1 also shows apparatus 43 and 45 for manually biasing applicator head 25 and doctor blades 27 toward and away from anilox roll 19.

FIG. 3 shows one exemplary arrangement of applicator head 25, doctor blades 27 and adjustment mechanism 35 in greater detail. In FIG. 3, doctor blades 27 mounted on applicator head 25 are shown as biased against anilox roll 19 so that doctor blades 27 are in continuous contact and form a sealing relationship with anilox roll surface 21 even as surface 21 rotates about applicator head 25 during operation of the printing press. Applicator head 25, doctor blades 27, sidewalls 31 and anilox roll surface 21 form a sealed, closed chamber 47. A plurality of ink jets (not shown) supplied with ink by supply lines 33 are positioned in chamber 47 to supply ink in the direction of arrow 51 on anilox roll surface 21 as anilox roll 19 rotates. Ink reservoir 53, FIG. 4A, is provided to collect excess ink. As best seen in FIG. 3, optional adjustable stop 49 is shown for limiting movement of applicator head 25 toward anilox roll 19.

In the exemplary embodiment shown in FIG. 3, a moveably-mounted support 55 in the form of a shaft is provided to support applicator head 25 and doctor blades 27 mounted on applicator head 25. Support 55 is preferably mounted for reciprocal movement in a corresponding opening 57 of member 59. A liner 61 may be provided in opening 57 and positioned against shaft 55 to reduce friction.

Support 55 has one end 63 in contact with applicator head 25. In the example shown, end 63 is attached to applicator head 25 by plate 65 and suitable fasteners 67. Support 55 has another end 69 for engaging a shaft-biasing device 71. The preferred shaft-biasing device is a cam 73 although it is contemplated that other apparatus could be used. A spring 75 may be positioned around support 55 and between shoulder 77 and flange 79 to provide a force urging support 55 away from anilox roll 19.

Adjustment mechanism 35 for urging doctor blades 27 against anilox roll 19 is most preferably a camming system. It has been found that a camming system provides an exceptionally reliable form of constant force for urging doctor blades 27 against anilox roll 19.

Figure 2:
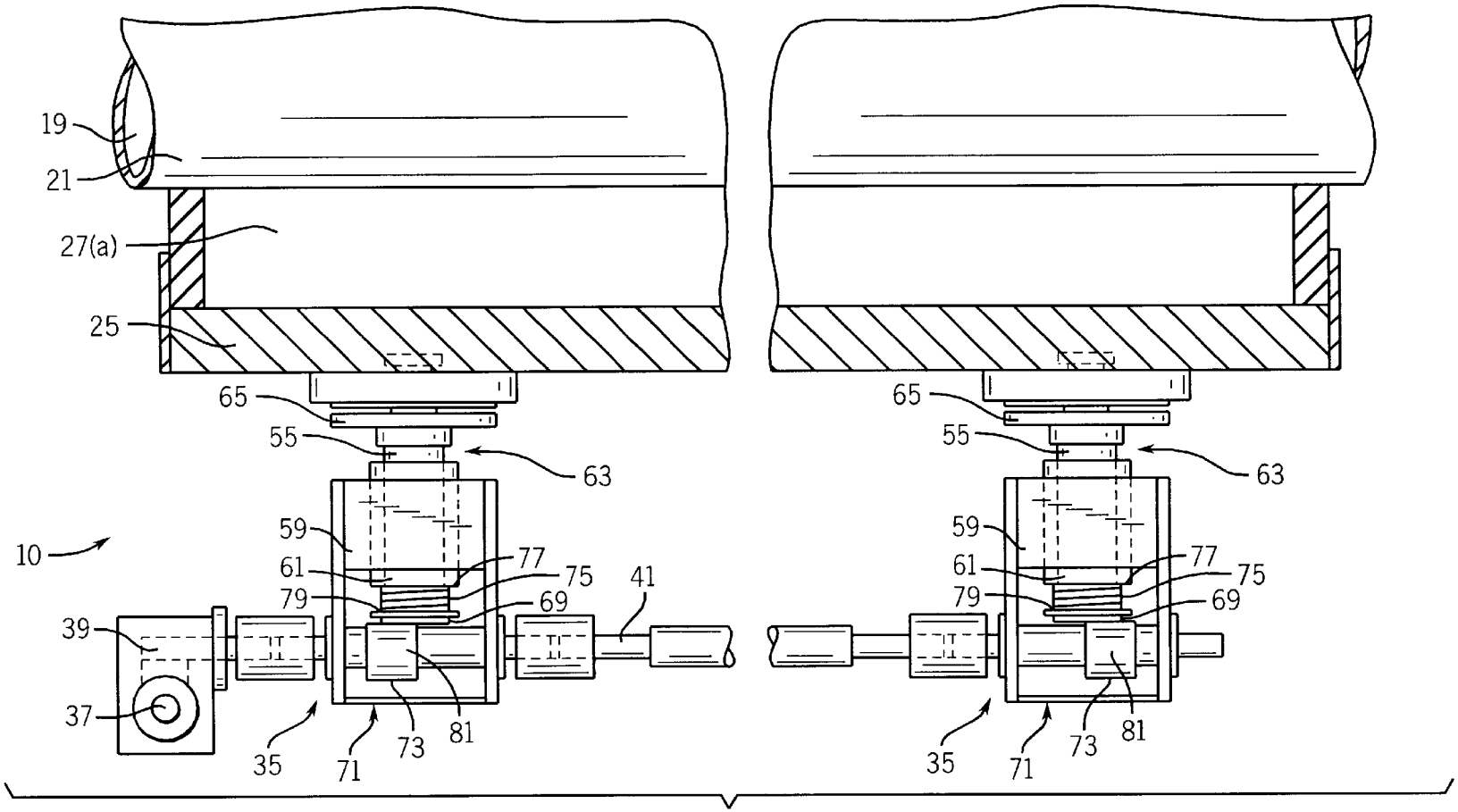
FIG. 2 is top plan view, partially broken away, taken along section 2—2 of FIG. 1.

FIGS. 2 and 3 illustrate one form of a highly preferred camming system. Actuator 37 is provided to maintain a constant force on shaft 41. Actuator 37 preferably includes a control (not shown) to control the actuator to provide the constant force. Actuators are well-known and any type of appropriate actuator will suffice for purposes of this invention. Actuator 37 may be further driven by a computerized control (not shown) in order to precisely control its operation. The utility of such a computerized control will become apparent with respect to the automatic indexing feature of the invention which will be described in more detail below.

Actuator 37 is engaged to linkage 39 which may be a rack and pinion linkage or other linkage of a suitable type. Linkage 39 is, in turn, rotatably engaged to shaft 41. Cam 73 is mounted on shaft 41. Cam 73 has an eccentric camming surface 81. A plurality of cams may be used as shown in FIG. 2.

FIGS. 4A and 4B illustrate operation of apparatus 10 as well as the ink distribution method. In FIG. 4A, doctor blades 27 are shown to be in continuous contact with anilox roll surface 21. Support 55, on which applicator head 25 and doctor blades 27 are mounted, is urged toward anilox roll by engagement at end 63 with eccentric camming surface 81 as cam 73 is rotated in the clockwise direction shown by arrow 83. Ink is applied in the direction of arrow 51 to anilox roll surface 21 by an ink supply (not shown) as anilox roll 19 is rotated. Ink on anilox roll surface 21 is evenly distributed over roll surface 21 by the scraping or shaving action of doctor blades 27 as anilox roll 19 is rotated.

A constant force is automatically applied to bias doctor blades 27 against anilox roll surface 21. As shown best in FIG. 4B, doctor blades 27 have been worn away by operation of the printing press yet remain in constant contact with anilox roll surface 21. This contact occurs because actuator 37 applies constant force through linkage 39 and shaft 41 to cam 73 causing cam to rotate in the direction of arrow 83 as doctor blades 27 are worn away. Eccentric camming surface 81 engages the cam-engaging end 69 of support 55 and urges support 55, applicator head 25 and doctor blades 27 toward anilox roll 19 and in the direction of arrow 85. As a result, doctor blades 27 remain in contact with anilox roll surface 21 even as blades 27 are worn away thus avoiding any need for constant manual inspection and adjustment of applicator head 25 and doctor blades 27 during operation of the printing press. This apparatus and method ensures even distribution of ink and prevents ink leakage.

Another feature of this invention made possible by adjustment mechanism 35 is that doctor blades 27 may be indexed against anilox roll surface 21 in a predetermined manner to ensure formation of a sealing engagement between the doctor blades 27 and anilox roll surface 21 and to avoid any damage which might occur as a result of such engagement Applicator head 25 and doctor blades 27 are first brought closely adjacent to anilox roll surface 21 by adjustment apparatus 43 and 45. Actuator 37 is programmed or controlled by an appropriate controller (not shown) to rotate cam 73 through shaft 41 and linkage 39 to gradually urge support 55, applicator head 25 and doctor blades 27 toward anilox roll 19 until blades 27 engage anilox roll surface 21. Actuator 37 may be programmed to urge doctor blades 27 toward anilox roll surface 21 at a first rate of movement and, subsequently at a second, lesser rate of movement until doctor blades 27 engage anilox roll surface.

While the principles of this invention have been described in connection with specific embodiments, it should be understood clearly that these descriptions are made only by way of example and are not intended to limit the scope of the invention.

What is claimed is:

1. An applicator system for distributing ink applied to an anilox roll comprising:

a blade for distributing the ink applied to the anilox roll; and an adjustment mechanism supporting the blade, the adjustment mechanism positioning the blade against the anilox roll;

a camming system for urging the blade against the anilox roll, the camming system comprising:

a shaft an actuator operatively connected to the shaft, the actuator rotating the shaft and maintaining a constant force on the shaft; and a cam mounted on and rotated by the shaft, the cam having a camming surface for engaging the adjustment mechanism and urging the adjustment mechanism toward the anilox roll.

2. The applicator system of claim 1 including second blade for further distributing ink applied to the anilox roll.

3. An apparatus for distributing ink applied to an anilox roll, comprising:

a pair of doctor blades;

an applicator head to which the blades are mounted;

a moveably-mounted support having one end for supporting the applicator head and another end for engaging a shaft-biasing device; and an actuator disposed to move the shaft-biasing device to engage the moveably-mounted support such that the support is moved toward the anilox roll and the blades engage the anilox roll, the actuator providing a constant force.

4. The apparatus of claim 3 wherein the shaft-biasing device is a cam.

5. The apparatus of claim 4 wherein:

the cam is mounted on a shaft;

the shaft rotatably engages the actuator; and the actuator is constructed to rotate the shaft such that the mounted cam engages the moveably-mounted support as the cam rotates and urges said support toward the anilox roll.

6. A method for distributing ink applied to an anilox roll surface comprising the steps of:

engaging the anilox roll surface with a blade;

rotating the anilox roll;

applying ink to the surface of the rotting anilox roll;

distributing the ink on the rotating anilox roll surface with the blade; and automatically applying a constant force to bias the blade against the anilox roll surface by camming the blade against the anilox roll, the cog of the blade comprising the steps of:

setting an actuator to maintain a constant force on a shaft;

rotating the shaft with the actuator;

rotating a cam mounted on the shaft, the cam having an eccentric camming surface; and urging a blade support toward the anilox Toll by engaging the cam outer surface against the support.

7. The method of claim 6 further comprising the additional steps of engaging the anilox roll surface with a second blade.

8. A method for distributing ink applied to an anilox roll surface comprising the steps of:

indexing a blade against the anilox roll in a predetermined manner, the indexing step including the steps of:

programming an actuator to rotate a shaft in a predetermined manner;

rotating the shaft with the actuator through a linkage;

rotating a cam mounted on the shaft, the cam having an eccentric camming surface; and urging a blade support toward the anilox roll by engaging the camming surface against the support such that the blade approaches and engages the anilox roll in a predetermined manner;

rotating the anilox roll;

applying ink to the surface of the rotating anilox roll;

distributing the ink on the rotating anilox roll surface with the blade; and automatically applying a constant force biasing the blade against the anilox roll surface.

9. The method of claim 8 wherein the urging step comprises:

urging the blade toward the anilox roll at first rate of movement and, subsequently;

urging the blade toward the anilox roll at a second, lesser rate of movement until the blade engages the anilox roll.

10. The method of claim 8 further comprising the additional step of indexing a second blade against the anilox roll in a predetermined manner.

11. An applicator system for distributing ink applied to an anilox roll, comprising:

a blade engagable with the anilox Toll for distributing ink applied thereto;

a support structure for supporting the blade;

a camming structure engaging the support structure for urging the blade against the anilox roll with a predetermined, constant force, the camming structure movable between first and second positions to adjust the position of the blade; and an actuator operatively connected to the camming structure, the actuator automatically moving the caning structure in response to the wearing away of the blade through use such that the camming structure maintains the blade against the anilox roll with the predetermined, constant.

12. The applicator system of claim 11 further comprising a second blade supported by the support structure, the second blade engageable with the anilox roll in response to urging by the camming structure.

13. The applicator system of claim 12 wherein the camming structure includes a cam engaging the support structure such that rotation of the cam in a first direction urges the blade toward the anilox roll and rotation of the cam in a second direction withdraws the blade from the anilox roll.

14. The applicator system of claim 13 wherein the cam is rotated in the first direction in response to the wearing away of the blade during contact with the anilox roll such that the blade continues to engage the anilox roll with the predetermined force as the blade is worn away.

15. An applicator system for distributing ink applied to an anilox roll, comprising:

a blade engagable with the anilox roll for distributing ink applied thereto, the blade wearing away in response to engagement with the anilox roll;

a support structure for supporting the blade; and an actuating structure engaging the support structure for positioning the blade against the anilox roll and for subsequently urging the blade against the anilox roll with a predetermined, constant force;

wherein the actuating structure includes a means for moving the blade to a first position spaced from the anilox roll at a first rate of movement and moving the blade from the first position into contact with the anilox roll at a second rate of movement.

16. The applicator system of claim 15 wherein the first rate of movement is greater than the second rate of movement.

17. The applicator system of claim 16 wherein the actuating structure includes a cam engaging the support structure such that rotation of the cam in a first direction urges the blade toward the anilox roll aid rotation of the cam in a second direction withdraws the blade from the anilox roll.

18. The applicator system of claim 17 wherein the cam is rotated in the first direction in response to the wearing away of the blade during contact with the anilox roll such that the blade continues to engage the anilox roll with the predetermined force as the blade is worn away.

* * * * *